US009808090B2

(12) United States Patent
Carrera

(10) Patent No.: US 9,808,090 B2
(45) Date of Patent: Nov. 7, 2017

(54) FOOTREST DEVICE FOR ARMCHAIRS OR SOFAS

(71) Applicant: CIAR S.p.A., Pesaro (IT)

(72) Inventor: Massimo Carrera, Pesaro (IT)

(73) Assignee: CIAR S.p.A., Pesaro (IT)

( * ) Notice: Subject to any disclaimer, the term of this patent is extended or adjusted under 35 U.S.C. 154(b) by 0 days.

(21) Appl. No.: 14/743,291

(22) Filed: Jun. 18, 2015

(65) Prior Publication Data

US 2015/0366355 A1 Dec. 24, 2015

(30) Foreign Application Priority Data

Jun. 19, 2014 (IT) ..... BO2014A0342

(51) Int. Cl.
*A47C 7/50* (2006.01)

(52) U.S. Cl.
CPC ..... *A47C 7/506* (2013.01)

(58) Field of Classification Search
CPC ..... A47C 7/506
See application file for complete search history.

(56) References Cited

U.S. PATENT DOCUMENTS 2,974,720 A 3/1961 Jelinek
5,090,768 A * 2/1992 Re ..... A47C 7/506 297/68
5,354,116 A * 10/1994 May ..... A47C 1/0355 297/423.34
5,388,886 A * 2/1995 LaPointe ..... A47C 7/506 297/75
5,772,278 A * 6/1998 Kowalski ..... A47C 1/0355 297/85 L
5,845,961 A * 12/1998 LaPointe ..... A47C 1/0345 297/423.36
2008/0012396 A1 1/2008 Hoffmann et al.
2009/0072593 A1 3/2009 Hoffmann et al.
2012/0104827 A1* 5/2012 Murphy ..... A47C 1/037 297/85 M
2012/0112518 A1 5/2012 Murphy et al.
2012/0248831 A1 10/2012 Garland
2015/0366355 A1* 12/2015 Carrera ..... A47C 7/506 297/423.19

(Continued)

FOREIGN PATENT DOCUMENTS

DE 3524056 A1 1/1987
DE 19700617 A1 7/1998

(Continued)

OTHER PUBLICATIONS

Italian Search Report for Italian Patent Application No. IT BO20140342 dated Jan. 13, 2015.

(Continued)

*Primary Examiner* — Timothy J Brindley
(74) *Attorney, Agent, or Firm* — McCarter & English, LLP

(57) ABSTRACT

A footrest device for armchairs or sofas has two footrest panels, which have substantially the same width, and are movable under the thrust of a crank mechanism between an extracted operating position, in which the two footrest panels project from the front of a support frame, and a retracted rest position, in which the two footrest panels substantially overlap one another.

9 Claims, 3 Drawing Sheets

(56) References Cited

U.S. PATENT DOCUMENTS

2016/0045031 A1* 2/2016 Lawson ..... A47C 7/506
297/284.3

FOREIGN PATENT DOCUMENTS

DE 20104534 U1 7/2001
WO WO 2011/015316 A1 2/2011

OTHER PUBLICATIONS

European Search Report for European Patent Application No. 15173027.2 dated Sep. 17, 2015.
European Patent Office Notice of Opposition dated Apr. 12, 2017 for European Patent Application No. 15173027.2-1653.

* cited by examiner

FOOTREST DEVICE FOR ARMCHAIRS OR SOFAS

The present invention relates to a footrest device for armchairs or sofas.

In particular, the present invention relates to a footrest device for armchairs or sofas of the type comprising a support frame; a first footrest panel; a second footrest panel having a width substantially equal to a width of the first footrest panel; and an actuating device for moving the two footrest panels between an extracted operating position, in which the two footrest panels project from the front of the support frame, and a retracted rest position.

BACKGROUND OF THE INVENTION

Generally, the actuating device comprises a crank mechanism interposed between the support frame and the two footrest panels, and an actuating cylinder interposed between the support frame and the crank mechanism to move the two footrest panels between the extracted operating position and a retracted rest position.

The crank mechanism is configured in such a way that, when the two footrest panels are arranged in their retracted rest position, the first footrest panel is arranged in a substantially vertical position and the second footrest panel is folded beneath the armchair or sofa in a position substantially horizontal and at an angle of substantially 90° with respect to the first footrest panel.

The footrest devices for the known types of armchairs or sofas described above have some drawbacks mainly deriving from the fact that, during the movement between the extracted operating position and a retracted rest position, the second footrest panel takes positions at which the second footrest panel interferes with a support floor of the armchair or sofa and, thus, could damage its padding and/or the floor itself.

SUMMARY OF THE INVENTION

The object of the present invention is to provide a footrest device for armchairs or sofas which lacks the drawbacks described above and which can be produced in a simple and inexpensive manner.

According to the present invention, a footrest device for armchairs or sofas as claimed in the appended claims is provided.

BRIEF DESCRIPTION OF THE DRAWINGS

The present invention will now be described with reference to the accompanying drawings, which illustrate a non-limitative embodiment, wherein.

DETAILED DESCRIPTION OF THE INVENTION

Figure 1:
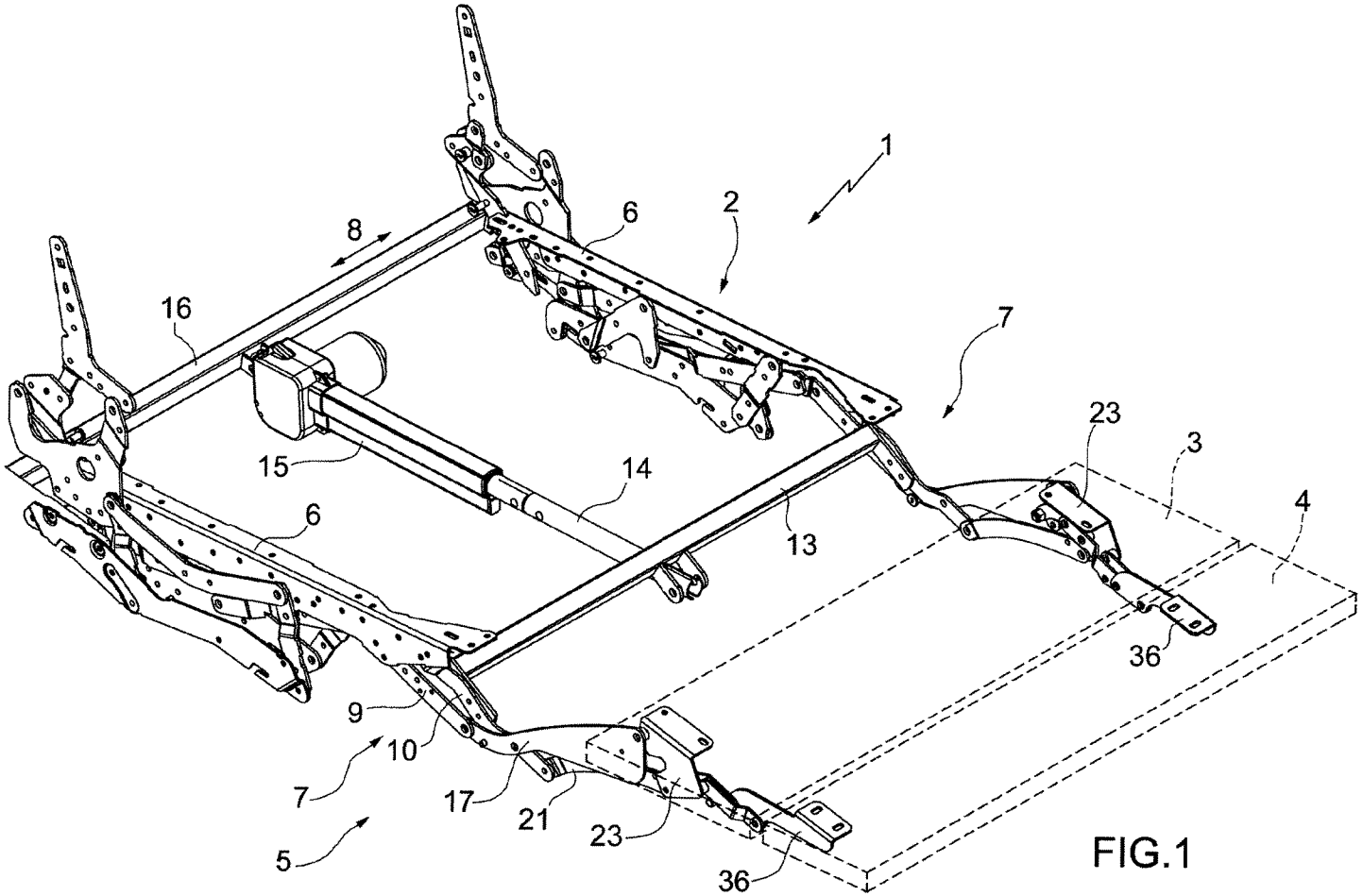
FIG. 1 is a schematic perspective view, with parts removed for clarity, of a preferred embodiment of the footrest device for armchairs or sofas of the present invention.
Figure 4:
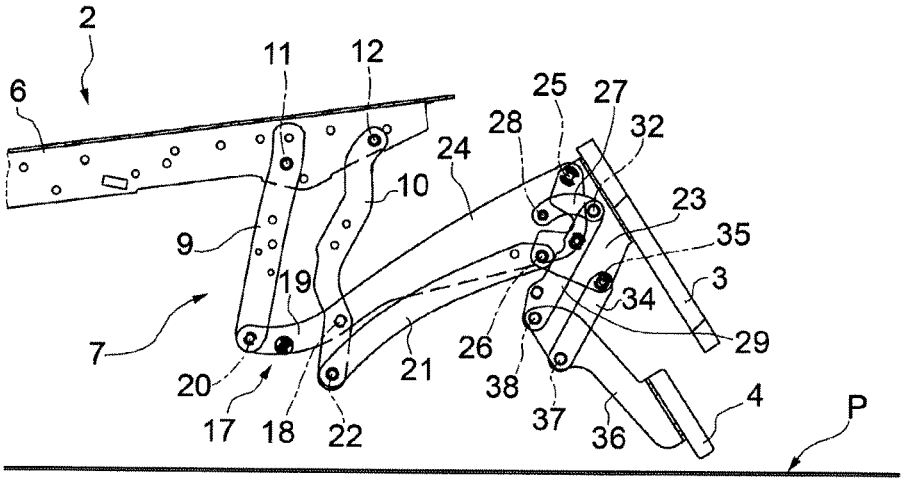
FIGS. 3, 4, and 5 are three schematic lateral views, with parts removed for clarity, of a detail of FIG. 2 shown in three different operating positions.
Figure 2:
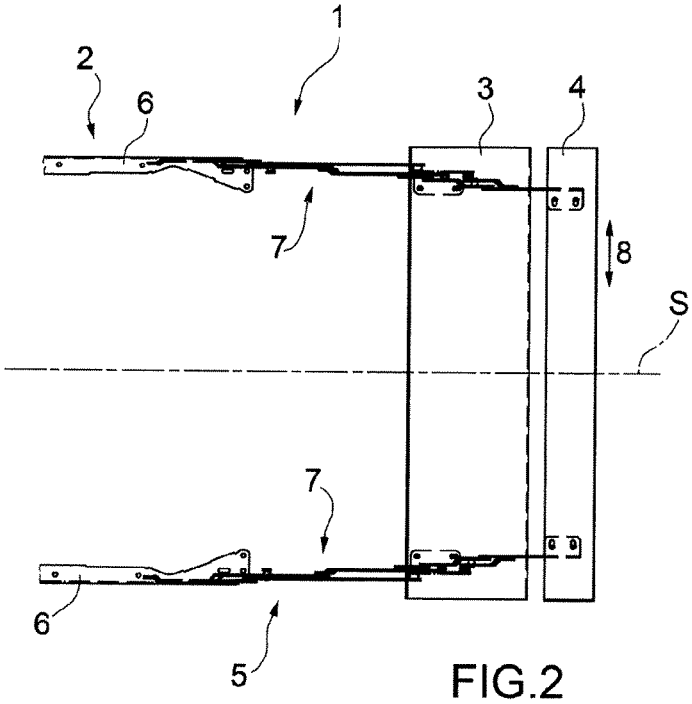
FIG. 2 is a schematic plan view, with parts removed for clarity, of a detail of the footrest device of FIG. 1.

With reference to FIGS. 1 and 2, number 1 indicates, as a whole, a footrest device for armchairs or sofas (not shown).

The footrest device 1 comprises a support frame 2 insertable in an armchair or sofa (not shown); a pair of footrest panels 3, 4 mounted at the front of the frame 2 and insertable in respective paddings (not illustrated); and a crank mechanism 5 interposed between the frame 2 and the panels 3, 4 themselves.

The frame 2 comprises two longitudinal side members 6 parallel to one another, and has a plane of longitudinal symmetry S parallel to the side members 6 themselves.

The crank mechanism 5 comprises two lever mechanisms 7, which are arranged on opposite sides with regard to plane S in a direction 8 perpendicular to the plane S itself, and are each associated to a respective side member 6.

Each lever mechanism 7 comprises two cranks 9, 10, which are hinged to the respective side member 6 to rotate, with respect to the frame 2, about respective fulcrum axes 11, 12 parallel to the direction 8.

The two cranks 10 are connected to one another by a first cross member 13, which extends parallel to direction 8, and supports the output rod 14 of an actuating cylinder 15 connected, in turn, to a second cross member 16 extending between the side members 6 parallel to the direction 8.

Each lever mechanism 7 further comprises a rocker arm 17 hinged at an intermediate point of the respective crank 10 to rotate, with respect to the crank 10 itself, about a fulcrum axis 18 parallel to the axes 11, 12. The rocker arm 17 has a first arm 19 hinged to the respective crank 9 to rotate, with respect to the crank 9 itself, about a fulcrum axis 20 parallel to the axis 18.

The lever mechanism 7 also comprises a connecting rod 21 hinged to a free end of the respective crank 10 to rotate, with respect to the crank 10 itself, about a fulcrum axis 22 parallel to the axis 20.

In addition, the lever mechanism 7 has a shaped bracket 23, which is hinged to a second arm 24 of the rocker arm 17 to rotate, with respect to the rocker arm 17 itself, about a fulcrum axis 25 parallel to the axis 22, and is hinged, furthermore, to a free end of the connecting rod 21 to rotate, with respect to the connecting rod 21 itself, about a fulcrum axis 26 parallel to the axis 25.

The brackets 23 of the two lever mechanisms 7 support the panel 3, which has a width L1, measured parallel to the direction 8, substantially equal to a width L2 of the panel 4 also measured parallel to direction 8.

Each lever mechanism 7 further comprises a connecting rod 27 hinged to the respective rocker arm 17 to rotate, with respect to the rocker arm 17 itself, about a fulcrum axis 28 parallel to the axis 26.

The connecting rod 27 is connected with a rocker arm 29, which is hinged to the bracket 23 to rotate, with respect to the bracket 23 itself, about a fulcrum axis 30 parallel to the axis 28, has a first arm 31 hinged to the connecting rod 27 to rotate, with respect to the connecting rod 27 itself, about a fulcrum axis 32 parallel to the axis 30, and has, moreover, a second arm 33.

The lever mechanism 7 further comprises a connecting rod 34 hinged to the bracket 23 to rotate, with respect to the bracket 23 itself, about a fulcrum axis 35 parallel to the axis 32, and a shaped bracket 36 hinged to the connecting rod 34 to rotate, with respect to connecting rod 34 itself, about a fulcrum axis 37 parallel to the axis 35 and to the arm 33 to rotate, with respect to the rocker arm 29, about a fulcrum axis 38 parallel to the axis 37.

The brackets 36 of the two lever mechanisms 7 support the panel 4.

Figure 5:
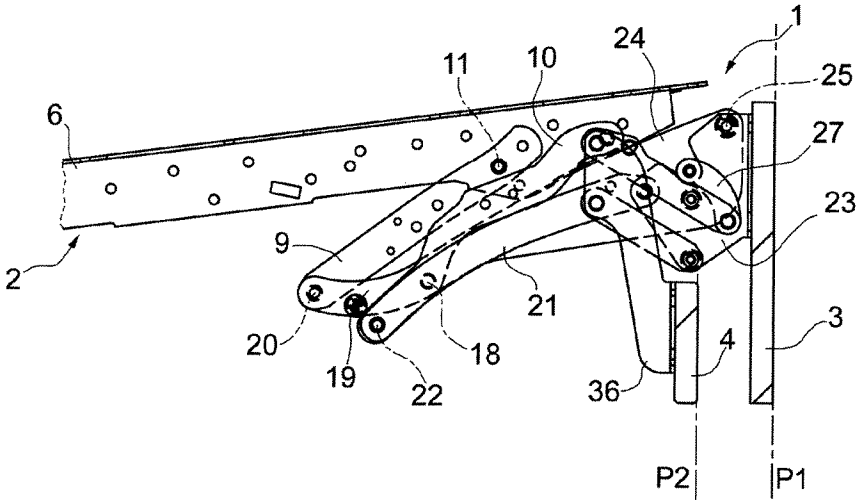
Figure 3:
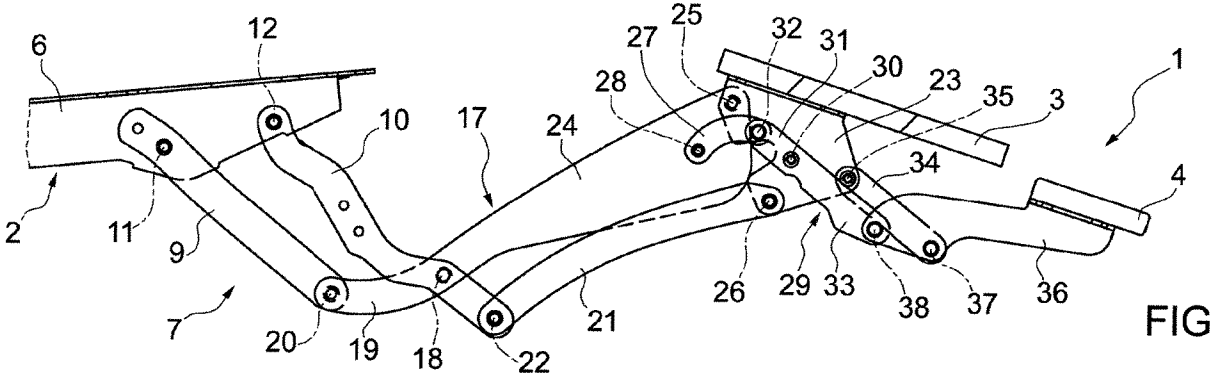

The two panels 3, 4 are moved by the crank mechanism 5 under the thrust of the actuating cylinder 15 between an extracted operating position (FIG. 1), in which the panels 3, 4 project at the front of the frame 2, and a retracted rest position (FIG. 5), in which the panels 3, 4 substantially overlap one another.

In connection to the abovementioned, it should be specified that:

when arranged in their retracted rest position, the two panels 3, 4 extend in respective containment planes P1, P2 distinct from one another and substantially parallel to one another; and when arranged in their extracted operating position, the two panels 3, 4 can be coplanar or parallel to one another.

In the present invention, containment planes P1, P2 substantially parallel to one another means two containment planes P1, P2 parallel to one another or arranged to one another at an angle between 0° and 10°.

The crank mechanism 5 is configured so as to enable the two panels 3, 4, during the movement between the extracted operating position and the retracted rest position, to take positions that prevent the two panels 3, 4 interfering with the support floor P of the armchair or sofa inside which the footrest device 1 is mounted.

In particular, during the movement from the extracted operating position to the retracted rest position, the panel 4 is progressively arranged inside a movement path of the panel 3 so as to maintain itself at a distance determined by the floor P.

The footrest device 1 has some advantages mainly deriving from the fact that the crank mechanism 5 is used to move two panels of equal width, i.e. the panels 3, 4, between the extracted operating position and the retracted rest position without interfering with the floor P and, therefore, without damaging the padding (not shown) of the panels 3, 4 and/or the floor P itself.

The invention claimed is:

1. A footrest device for armchairs or sofas comprising:

a support frame;

a first footrest panel;

a second footrest panel (4); and an actuating device to move the two footrest panels between an extended operating position, in which the two footrest panels project from the front of the support frame, and a retracted rest position;

the actuating device comprising a crank mechanism configured in such a way that, when arranged in their retracted rest position, the two footrest panels substantially overlap one another and are arranged in respective containment planes distinct from one another and substantially parallel to one another; and the second footrest panel is arranged behind the first footrest panel when the footrest panels are arranged in their retracted rest position and in front of the first footrest panel when the footrest panels are arranged in their extended operating position;

the crank mechanism comprising two lever mechanisms arranged on opposite sides with regard to a longitudinal symmetry plane of the support frame; and wherein the second footrest panel has a width equal to a width of the first footrest panel and greater than a space defined between the two lever mechanisms.

2. The footrest device according to claim 1, wherein, when the two footrest panels are arranged in their retracted rest position, the two containment planes are parallel to one another.

3. The footrest device according to claim 1, wherein, when the two footrest panels are arranged in their retracted rest position, the two containment planes are arranged to one another at an angle between 0° and 10°.

4. The footrest device according to claim 1, wherein the crank mechanism is configured in such a way that, during the movement from the extended operating position to the retracted rest position, the second footrest panel projects within a movement path of the first footrest panel.

5. The footrest device according to claim 1, wherein the actuating device further comprises actuating means interposed between the support frame and the crank mechanism so as to move the crank mechanism itself between the extended operating position and the retracted rest position of the footrest panels.

6. The footrest device according to claim 1, wherein the crank mechanism is configured in such a way to allow the footrest panels, during the movement between the extended operating position and the retracted rest position, to take positions that prevent the footrest panels interfering with a support floor of the footrest device itself.

7. The footrest device according to claim 1, wherein the crank mechanism comprises two lever mechanisms arranged on opposite sides with regard to a longitudinal symmetry plane of the support frame.

8. The footrest device according to claim 7, wherein each lever mechanism comprises a first crank and a second crank, which are hinged to the support frame, a first rocker arm, which is hinged to the first crank and which has a first arm hinged to the second crank, a first connecting rod hinged to the first crank, and a first support bracket, hinged to a second arm of the first rocker arm and to the first connecting rod, and supports the first footrest panel.

9. The footrest device according to claim 8, wherein each lever mechanism further comprises a second connecting rod hinged to the second arm of the first rocker arm, a second rocker arm hinged to the first support bracket and has a first arm hinged to the second connecting rod, a third connecting rod hinged to the first support bracket, and a second support bracket, hinged to the third connecting rod and to a second arm of the second rocker arm, and supports the second footrest panel.

* * * * *